US007128409B2

(12) United States Patent
Steinmetz et al.

(10) Patent No.: US 7,128,409 B2
(45) Date of Patent: Oct. 31, 2006

(54) REPLACEABLE PRINTING CONSUMABLE WITH FEATURES FACILITATING INTUITIVE INSTALLATION BY A USER

(75) Inventors: Charles R. Steinmetz, Corvallis, OR (US); Daniel R. Dwyer, BattleGround, WA (US); Yves Behar, San Francisco, CA (US); Peter G. Hwang, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/631,182

(22) Filed: Jul. 31, 2003

(65) Prior Publication Data

US 2005/0024447 A1 Feb. 3, 2005

(51) Int. Cl.
*B41J 2/175* (2006.01)

(52) U.S. Cl. ..... 347/86; 347/87

(58) Field of Classification Search ..... 347/86, 347/87

See application file for complete search history.

(56) References Cited

U.S. PATENT DOCUMENTS

| | | | | |
|---|---|---|---|---|
| 5,831,652 | A * | 11/1998 | Hinami et al. | 347/86 |
| 6,390,615 | B1 * | 5/2002 | Carrese et al. | 347/86 |
| 6,600,881 | B1 | 7/2003 | Cornelius | |
| 2003/0234844 | A1 * | 12/2003 | Yamamoto | 347/86 |

* cited by examiner

*Primary Examiner*—Julian D. Huffman

(57) ABSTRACT

Exemplary embodiments of the invention include replaceable printing consumables with a variety of features that facilitate intuitive installation of the consumables in printers. The features may be utilized in various combinations to provide multiple, consistent visual cues to a printer user regarding the proper installation of the consumable. The consumables may be, for example, ink containers for inkjet printers.

7 Claims, 7 Drawing Sheets

REPLACEABLE PRINTING CONSUMABLE WITH FEATURES FACILITATING INTUITIVE INSTALLATION BY A USER

TECHNICAL FIELD OF THE INVENTION

The present invention relates generally to printing systems, and more specifically to replaceable printing consumables.

BACKGROUND OF THE INVENTION

Printing systems, including inkjet printers, are well known in the art. Inkjet technology enables the printing of text and images by depositing very small droplets of ink onto a print medium, such as paper. Inkjet printheads are typically secured to a scanning carriage that traverses the print medium in a direction transverse to the direction of travel of the print media through the printer. Each printhead includes multiple tiny ink ejection elements formed in a substrate that are selectively "fired" by electrical signals, causing droplets of ink to be ejected in a controlled fashion onto the print medium.

Inkjet printers typically utilize replaceable ink supplies, which may be either integral with the printheads (in the form of "print cartridges"), or separate from the printheads (sometimes referred to as "separate ink and silicon"). When the printheads are integral with the ink supplies, the printheads are replaced each time new ink supplies are installed in the printer. When separate from the replaceable ink supplies, the printheads may be permanent or semi-permanent, with an ink delivery system routing ink from the supplies to the printheads. Since printheads are relatively expensive, "separate ink and silicon" configurations typically allow for a lower total cost of printer ownership.

If permanent or semi-permanent printheads are used, the replaceable ink supplies may be located remotely from the printheads and off the scanning carriage (referred to as "off-axis"). Locating the ink supplies off-axis reduces the scanning carriage mass and swept volume, which typically allows for mechanically simpler and more compact printer systems.

Printers are commonplace in business settings, and have long been used to print office documents. More recently, printers have become a common accessory to home computers. As printers become less expensive and more capable, a general trend has been for printers to increasingly move into new areas where the users are less familiar with business machines and may not be technically savvy. For example, a grandparent with no previous familiarity with computer equipment may now acquire a printer for use with a digital camera for printing vacation snapshots.

Individuals who have used printers or other office equipment for many years are generally familiar with the appearance of the printer consumables and with the installation procedures, and are therefore not intimidated by the prospect of having to periodically replace the consumables. In some of the newer printer markets, however, such as printers for use with point-and-shoot digital cameras, unfamiliarity with replacement procedures and the unfriendly, industrial appearance of the consumables can be impediments to adoption of the technology.

Other trends that can make maintaining a printer a daunting task for an unsophisticated user include the use of an increasing number of different ink colors for printing photographs, and the use of separate ink supplies for each ink color. Early color printers typically used three primary colors and black for printing color images; newer photograph-quality printers may use six or more ink colors to provide an improved image quality. Many earlier color printers utilized a single cartridge to contain all three of the primary color inks; separate ink supplies for each color are generally perceived to provide greater value since there is less potential for unutilized ink. A printer user may thus need to maintain a printer with six or more separate ink supplies.

There is thus a need for replaceable printing consumable with features facilitating intuitive installation by a user.

SUMMARY OF THE INVENTION

Exemplary embodiments of the invention include replaceable printing consumables with a variety of features that facilitate intuitive installation of the consumables in printers. The features may be utilized in various combinations to provide multiple, consistent visual cues to a printer user regarding the proper installation of the consumable. The consumables may be, for example, ink containers for inkjet printers.

Other aspects and advantages of the present invention will become apparent from the following detailed description, taken in conjunction with the accompanying drawings, illustrating by way of example the principles of the invention.

BRIEF DESCRIPTION OF THE DRAWINGS

These and other features and advantages of the present invention will become more apparent from the following detailed description of exemplary embodiments thereof, as illustrated in the accompanying drawings, in which.

DESCRIPTION OF EXEMPLARY EMBODIMENTS

Figure 1:
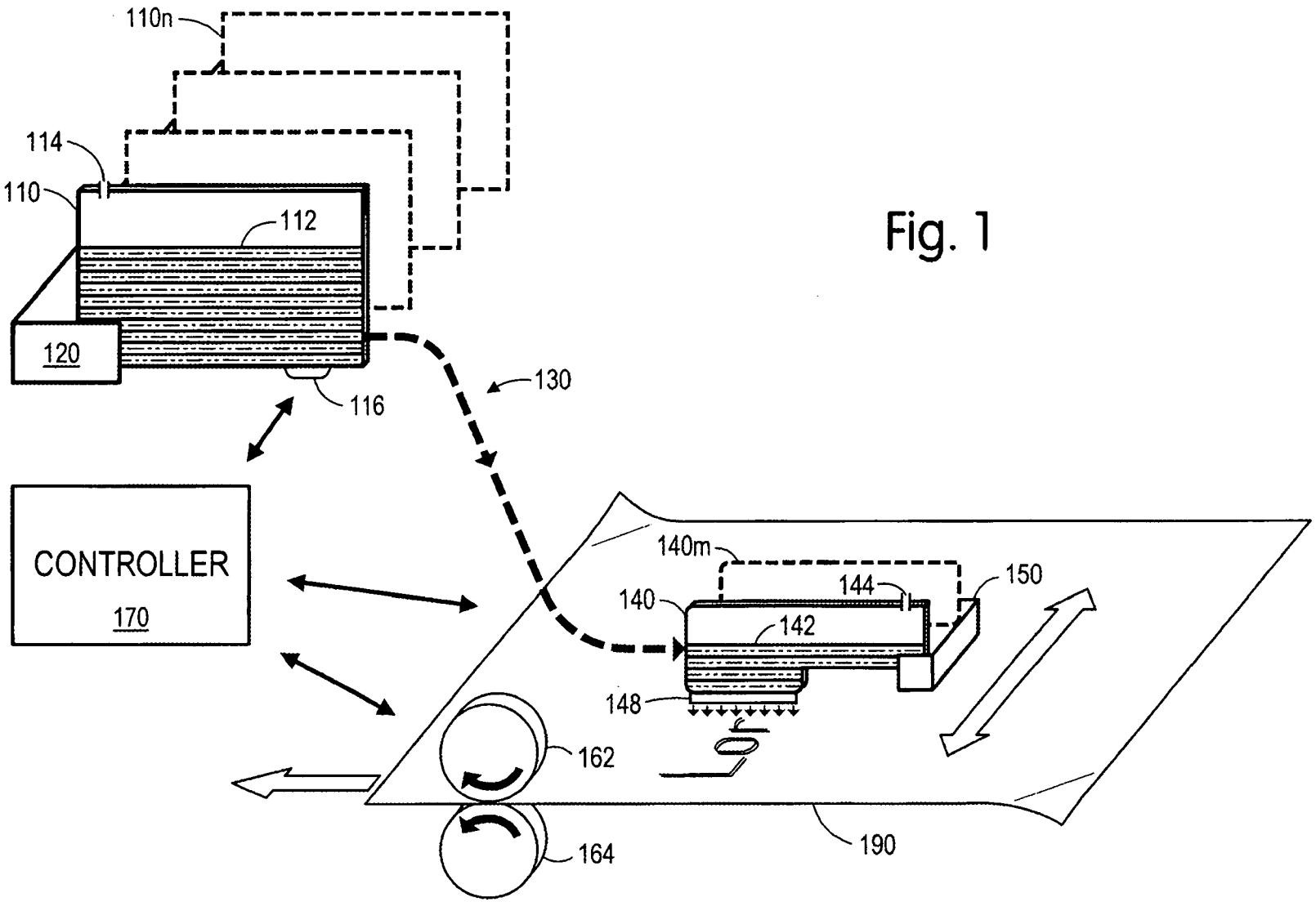
FIG. 1 is an abstracted representation of an exemplary "off-axis" printing system in which embodiments of the present invention may be used.
Figure 2A:
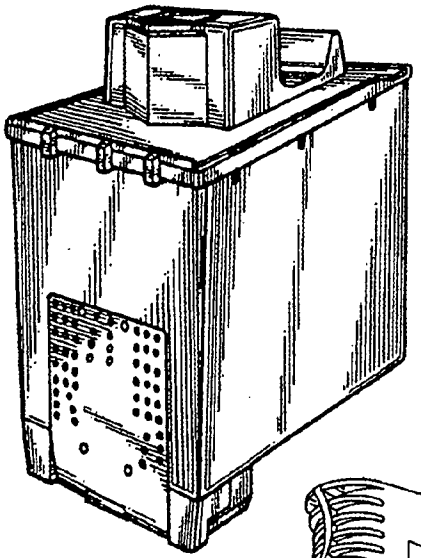
Fig. 2(a) (Prior Art)
FIGS. 2(*a*), 2(*b*), 2(*c*), and 2(*d*) illustrate exemplary prior art printing consumables.
Figure 2B:
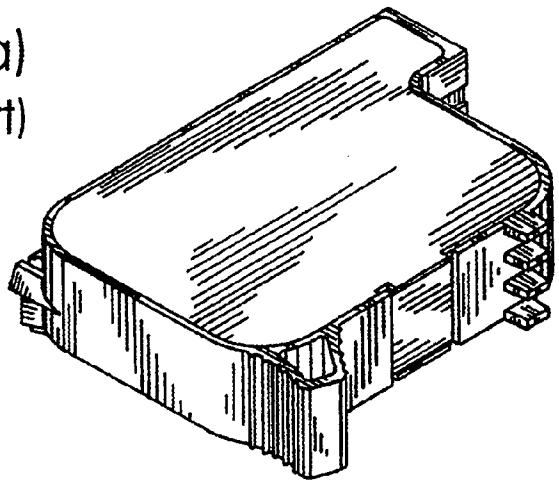
Fig. 2(b) (Prior Art)
Figure 2C:
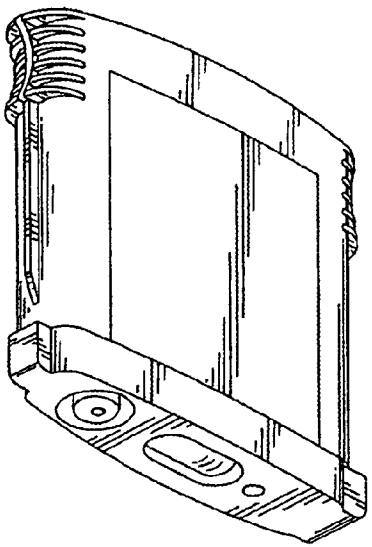
Fig. 2(c) (Prior Art)
Figure 2D:
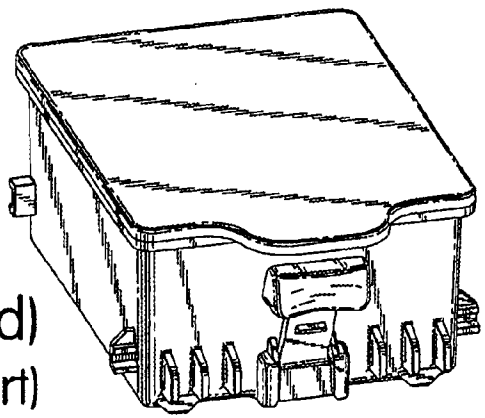
Fig. 2(d) (Prior Art)

FIG. 1 is an abstracted representation of an exemplary "off-axis" printing system in which embodiments of the present invention may be utilized. The exemplary printing system has at least one replaceable ink supply 110 containing a quantity of ink 112. The exemplary printer may include multiple supplies, such as supplies for each of three primary colors and black, as denoted by phantom lines 110*n* in FIG. 1. The multiple supplies may be housed within a common container or may be independently replaceable, and are typically held in a stationary "off-axis" supply receiving station 120 when installed in the printer. Each replaceable supply 110 may retain the ink 112 in a capillary material (not shown in FIG. 1) such as a foam material, a fibrous material, or other substance; or the supply may contain "free ink" (ink which is not retained in a capillary material). The ink supply may include a venting mechanism 114 to maintain an appropriate pressure relationship between the interior of the supply and the ambient air, or another pressure regulating mechanism known in the art. Other configurations of ink supplies are also known in the art, such as pressurized supplies; the supplies may other supply other fluids to the printheads, such as pre-coating or over-coating "fixer" fluids.

The replaceable ink supply 110 may also include an integral memory device 116 that is programmed with information pertaining to the ink supply and the printing system. The memory device may include both non-alterable non-volatile memory, as well as memory which may be modified by the printer controller 170 or by the device to which the printer is connected, such as a computer (not shown). The memory device 116 may communicate with the controller 170 or connected device through electrical contacts on the supply that engage mating contacts in the supply receiving station 120 when the supply is installed in the receiving station, or the memory device may communicate through a wireless date link (not shown).

Ink 112 from the supply 110 is provided to a printhead 140 through an ink delivery system 130, which may take many forms (represented in FIG. 1 by a dashed line). For example, the ink delivery system may utilize "trailing tubes," in which flexible tubes connect the chassis-mounted supply the carriage-mounted printhead, or it may entail the intermittent fluidic connection of the printhead and supply (sometimes referred to as "take-a-sip"—see, for example, U.S. Pat. No. 6,302,503, "Inkjet ink level detection"). Trailing tube ink delivery systems may provide ink to the printhead through a single tube, with the ink driven through the tube by a pressure differential created by the height of the supply above the printhead or by differential capillary affinities, or may provide for the recirculation of ink through the printhead and back to the supply, with the ink typically driven by a pump. When permanent or semi-permanent printheads are used, ink recirculation can extend the useful lifetimes of the printheads by purging air from the printheads. The ink delivery system may also include one or more pressure regulating devices (not shown), configured to insure the reliable delivery of ink to the printhead. Although described as an "ink delivery system", other fluids may be provided to the printhead, such a fixer fluid.

The ink delivery system 130 may provide ink the printhead 140 on a continuous basis, or may be configured to intermittently refill the printhead during non-printing intervals, receiving ink from the ink delivery system 130 and storing a small quantity of ink 142 in a local reservoir within the printhead assembly.

The exemplary printer may include multiple printheads, such as printheads for each of the primary colors and black, as denoted by phantom lines 140*m*. A printhead may include a single row of ink ejection elements for printing a single ink color, or multiple rows of ink ejection elements may be incorporated into a single printhead, with each row printing a different color. The printhead is typically attached to a scanning carriage 150 that reciprocates across the print medium 190. A printhead also typically includes one or more mechanisms for controlling ink backpressure, such that ink does not "drool" from the printhead nozzles. For example, in FIG. 1 the printhead 140 is depicted with a capillary material filling its local ink reservoir, with a vent 144 to maintain a proper pressure relationship with ambient air.

The exemplary printing system of FIG. 1 also has a media handling mechanism, as represented by rollers 162, 164, which move sheets of media 190 through the printer, typically advancing the media by one printhead scan width after each pass of the carriage. Other types of media handling mechanisms and other forms of media may also be used.

A printer controller 170 typically manages all aspects of the printing process, including: controlling and monitoring the scanning carriage 150 and the media handling mechanism 162, 164; receiving print data from an external source such as a computer (not shown in FIG. 1); generating print data and control signals for the printhead; and accessing and storing information on the integral memory device 116.

FIGS. 2(*a*), 2(*b*), 2(*c*), and 2(*d*) illustrate exemplary prior art printing consumables. FIGS. 2(*a*) and 2(*b*) depict print cartridges having integral printheads; FIGS. 2(*c*) and 2(*d*) depict replaceable ink containers without printheads. The replaceable container of FIG. 2(*c*) may typically be used in an "off axis" system, while the container of FIG. 2(*d*) may be carried on the scanning carriage of a printer. Although the general appearances of the consumables differ, it may be observed that the appearances of the consumables do not convey a clear impression of how the consumables are to be picked up or held by the user.

The consumables include a variety of fluid interconnects, air vents, pumping mechanisms, electrical circuitry, mechanical keying features, and levers for actuating latching mechanisms; an unsophisticated user may be apprehensive about coming into contact with these printer functional interfaces. To an unsophisticated user, the various interfaces may be seen collectively as "nasty bits" to be avoided. The designs of the prior art consumables of FIGS. 2(*a*) through 2(*d*) also generally do not convey an indication of how the consumables physically relate to a printing system, which may further discourage a user unfamiliar with printers from attempting to replace a spent consumable.

Typically, the prior art printing consumables include a printed label (not illustrated in FIGS. 2(*a*)–2(*d*)) that indicates the ink color and other characteristics of the consumable, and possibly information on the steps required to install the consumable in the printer system. A sheet of instructions (also not illustrated) may be included with the purchased consumable, leading the purchaser through the installation process. While adequate for a knowledgeable user, unsophisticated users may not be adept at following these written instructions.

Figure 3:
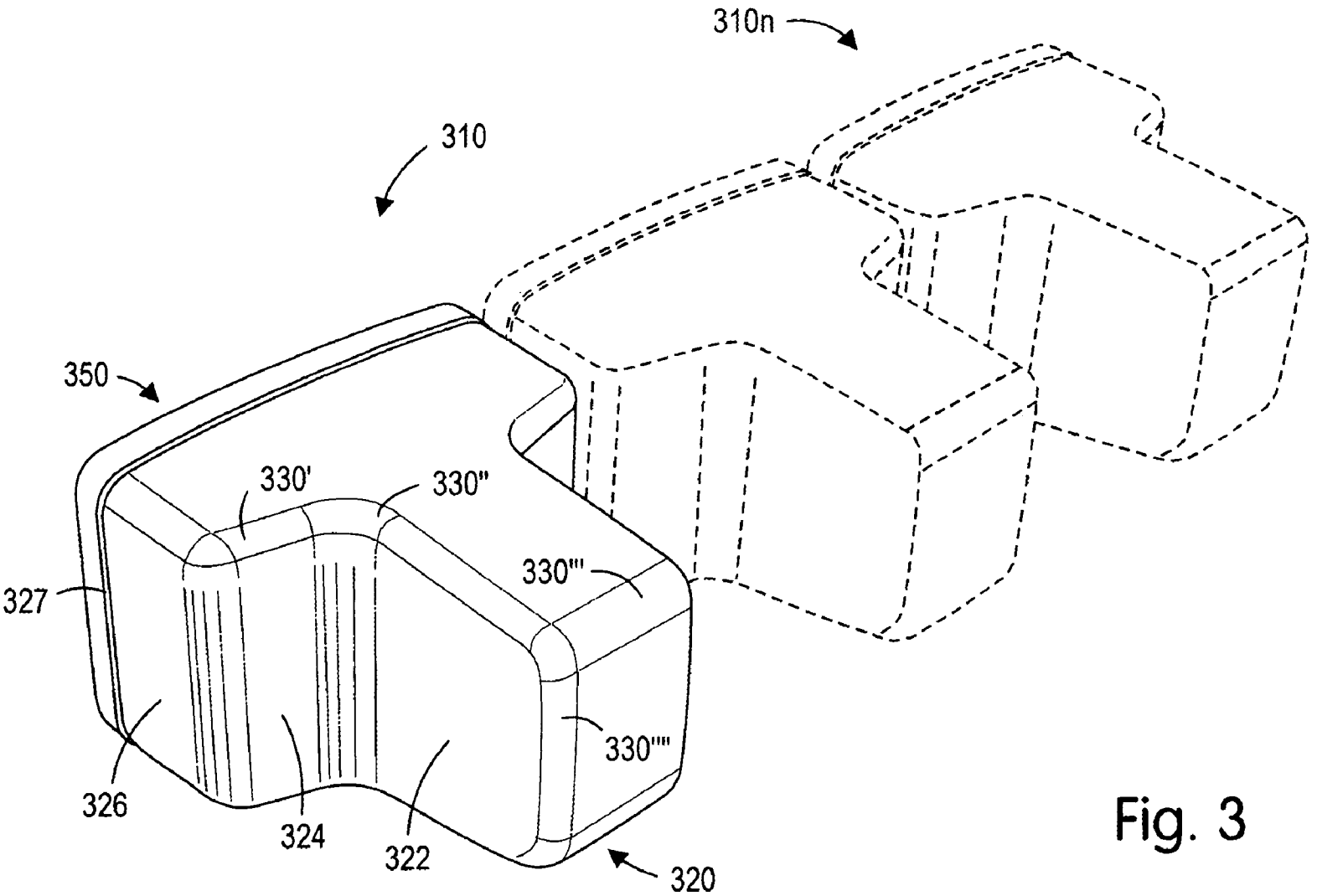
FIG. 3 illustrates an exemplary printing consumable incorporating embodiments of features facilitating intuitive installation by a user.

FIG. 3 shows a replaceable printer consumable 310 incorporating embodiments of features to facilitate intuitive installation by a user. Among the features are the segregation of printer interfaces to a printer interface portion 350 of the consumable; a grasping portion 320 separate from and demarcated from the printer interface portion; finger contact areas 322, finger stops 324, and rounded or "softened" edges, as denoted, for example, at 330', 330", 330''', and 330''''. The features may also include discriminating marks, signs, tokens, indications, appearances, or other "indicia" of characteristics of the consumable contents, such as ink color, as discussed below. In an exemplary printing system, a receiving station may be configured to receive a plurality of consumables in a side-by-side arrangement, such as indicated in phantom at 310*n*.

As illustrated in FIG. 3, the rear or "grasping portion" 320 may have a reduced cross-sectional area with respect to the front or "printer interface" portion 350, such that the grasping portion is perceived by the user as convenient handle. An area on either side of the grasping portion 320 forms a finger contact area 322. In the exemplary embodiment of FIG. 3, the finger contact area 322 is shown as substantially flat; it may have other forms, such as concave or convex, so long as the appearance conveys to the user that area is a convenient and safe place to hold the consumable. In the exemplary embodiment of FIG. 3, the front portion 326 of the grasping portion 320 expands in cross-sectional area, creating areas that serve as finger stops 324. As illustrated in FIG. 3, the finger stops 324 present a combined surface area that is substantially equal to the difference between the surface area of the printer interface portion 350 and the area of the user interface end of the container. The finger stops 324 also further identify the grasping end as a handle, and confine the user's fingers to the rear portion of the consumable. The finger stops 324 can be formed from a narrowing of the consumable as shown in FIG. 3, or could alternatively be protuberances extending from the container (not shown). The extended, narrowed rear portion of the consumable with rounded or softened edges, together with the finger stops, thus create a portion of the container that is isolated from the printer interconnects, and that is perceived as "safe" to grasp by the printer user. "Safe" to the user means that there is little chance of inadvertently touching a fluid interconnect or electrical contact, soiling the user's hand or clothing, or contaminating the consumable in some manner.

A feature that helps to make the consumable "friendly" is the clear visual demarcation between "printer" end and "user" end. Embodiments of this feature may include forming the front or printer interface portion 350 of a material of a different, contrasting color, different texture, or different opacity than the material used for the grasping portion 320, such that it is immediately apparent to the user where the printer interface or "unfriendly" portion of the consumable stops, and the user interface or "safe" portion of the consumable begins. The clear demarcation between the "printer" end and the "user" end may also include a well-defined boundary between the two ends having an uncomplicated shape, such as, for example, the boundary 327 falling substantially along a single plane shown in FIG. 3.

Figure 4:
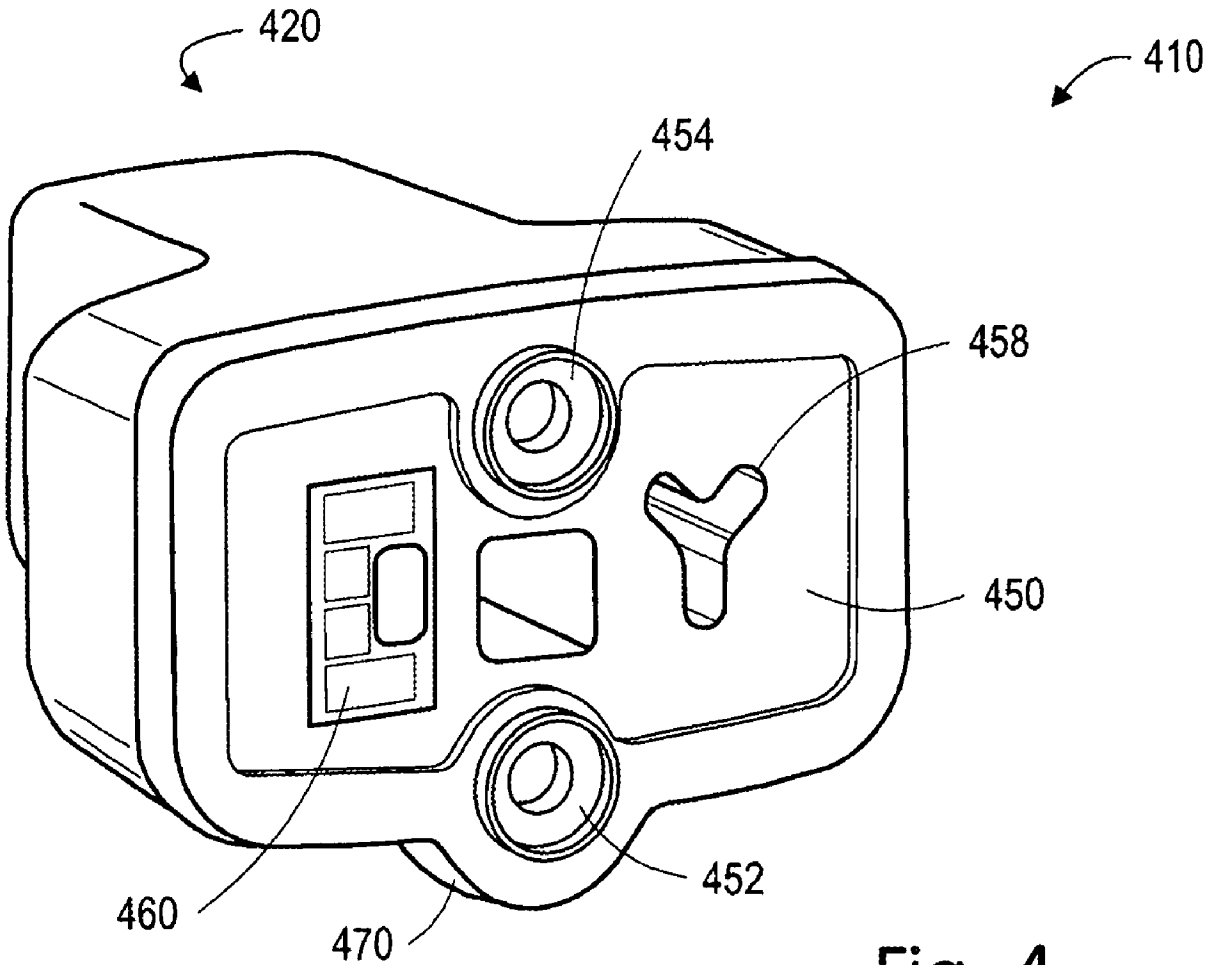
FIG. 4 illustrates the printer interface end of an exemplary printer consumable.

FIG. 4 illustrates the printer interface end of the exemplary consumable. In the embodiment of FIG. 4, the printer interface end 450 is substantially flat, and may include any of a variety of mechanical, fluid, or electrical interfaces. For example, interfaces may include fluid ports 452, air vent ports 454, mechanical alignment features 456, mechanical keying features 458, or electrical interfaces 460. The front of the consumable 410 may further include an extension or bulge 470 which aids the user in identifying the bottom of the consumable, as discussed below.

Figure 5:
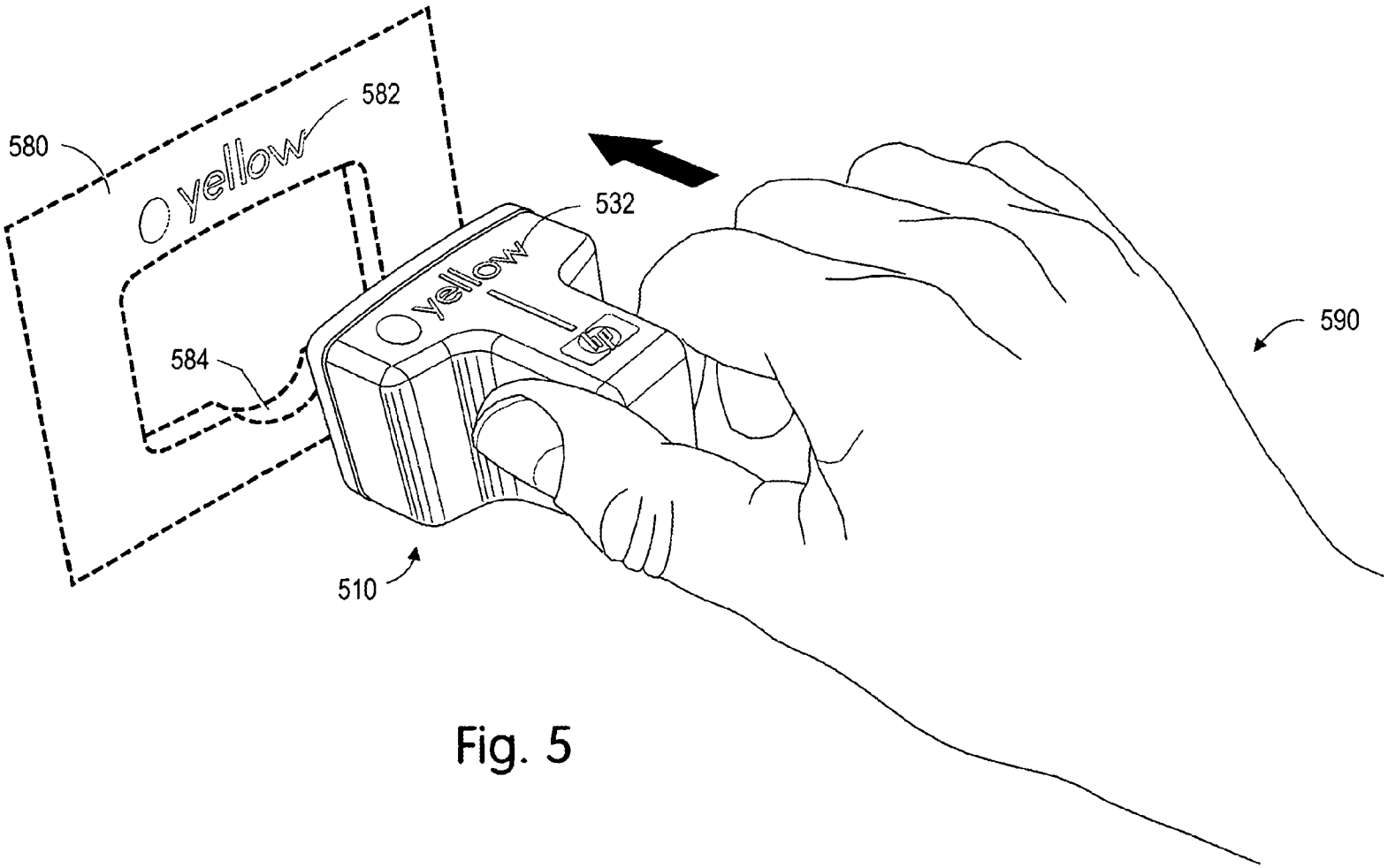
FIG. 5 illustrates how a printer consumable incorporating embodiments of the invention may be intuitively installed in a printer.

FIG. 5 illustrates how a printer consumable incorporating embodiments of the invention may be installed in a printer. With the printer interfaces segregated on a single surface, the user may remove a new consumable from its packaging by grabbing hold of the grasping portion. The consumable 510 may typically be grasped between thumb and forefinger of a user's hand 590, with the printer interface portion intuitively facing away from the user. The user identifies the correct slot for the consumable, aided by indicia of consumable contents 532 on the consumable, and matching indicia 582 on the receiving station 580, as further discussed below. A cue to the user as to proper orientation of the consumable may be provided by a keyway 584 in the receiving station, which corresponds to the extension or bulge 470 on the consumable as shown in FIG. 4. To install the consumable, the user moves the consumable 510 linearly forward into the receiving station 580.

It may be observed that the shape of the exemplary consumable resembles a ink stamp, an object familiar to virtually everyone, and whose use is intuitive. The act of installing the consumable in a printer receiving station emulates or mimics the physical action of using a stamp, in that the ink container is grasped (typically in the aperture between thumb and forefinger), and moved forward linearly, with the substantially flat printer interface end engaging the printer ink supply station much as an ink stamp is pushed against a sheet of paper. Thus, the relationship of the consumable to the printer is made analogous to a familiar object that is also used for creating images on paper.

As explained below, the exemplary consumable may include a prominently-displayed indicia of contents, which the user may match with a corresponding indicia 582 on the consumable receiving station 580. The indicia may, for example, represent ink color. One form of indicia includes manufacturing the grasping portion or user end of the consumable from a colored material, such that the color of the consumable substantially corresponds to the color of the ink it contains. All or part of the surface area of the grasping area may alternatively be colored with a paint or other pigmented material applied to the surface, or a colored label may be used (not shown). Written indicia 632 may also be used to indicate the consumable contents and to provide an additional orientation cue to the user. Symbolic indicia, such as the circle 233 in FIG. 6, may also be used (e.g., each ink color may be given a symbol, such as a circle for yellow, a triangle for blue, etc., which the user can match with corresponding symbols on the consumable receiving station). Multiple cues may be used, such as uniquely colored consumables combined with written indicia and symbols, to reinforce the message to the user of proper orientation and use.

Figure 6:
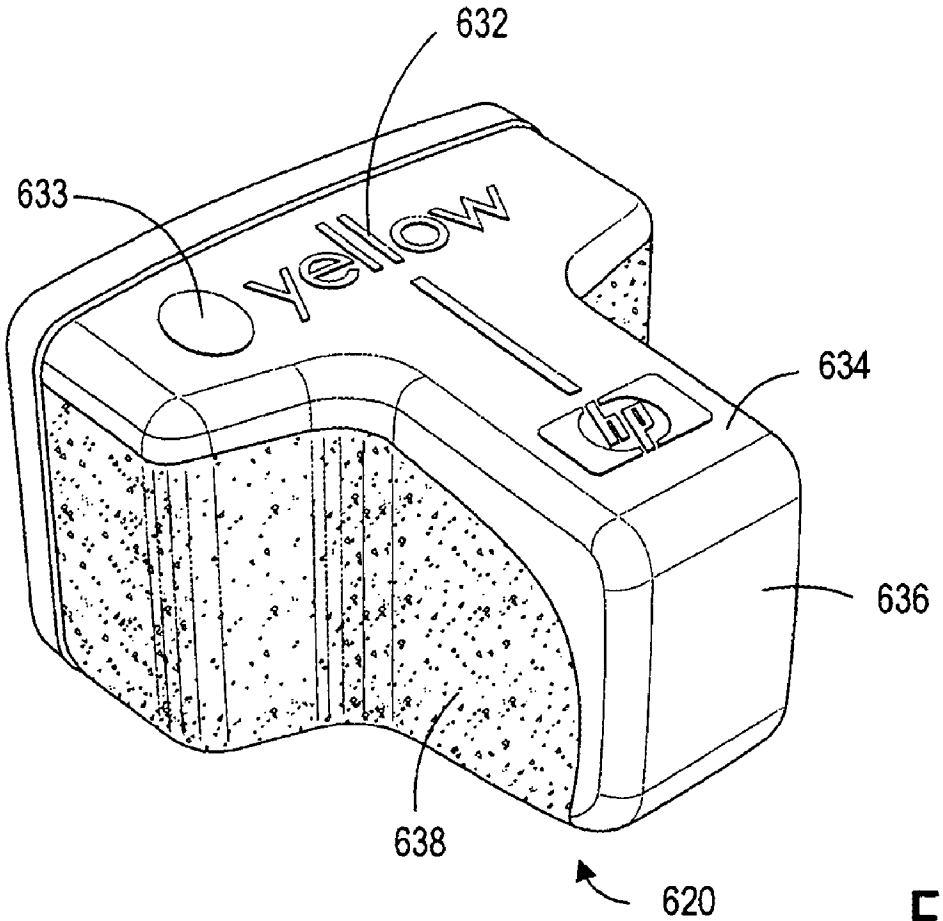
FIG. 6 illustrates additional features that may be utilized in embodiments of the invention to provide visual cues facilitating installation of the printer consumables.

FIG. 6 illustrates additional features that may be utilized to provide additional consistent visual cues to the user of the proper orientation of the consumable. In FIG. 6, the surface of the grasping portion 620 is divided into regions. The regions facing the user when the consumable is correctly held for installation (the top 634 and back 636) are substantially a first color, such as the color of the contained ink. The other regions of the grasping portion, such as sides 638, are substantially a contrasting second color, such as black or another neutral color. The user would thus intuitively orient the consumable such that the colored areas face the user, and the neutral areas face away from the user.

Figure 7:
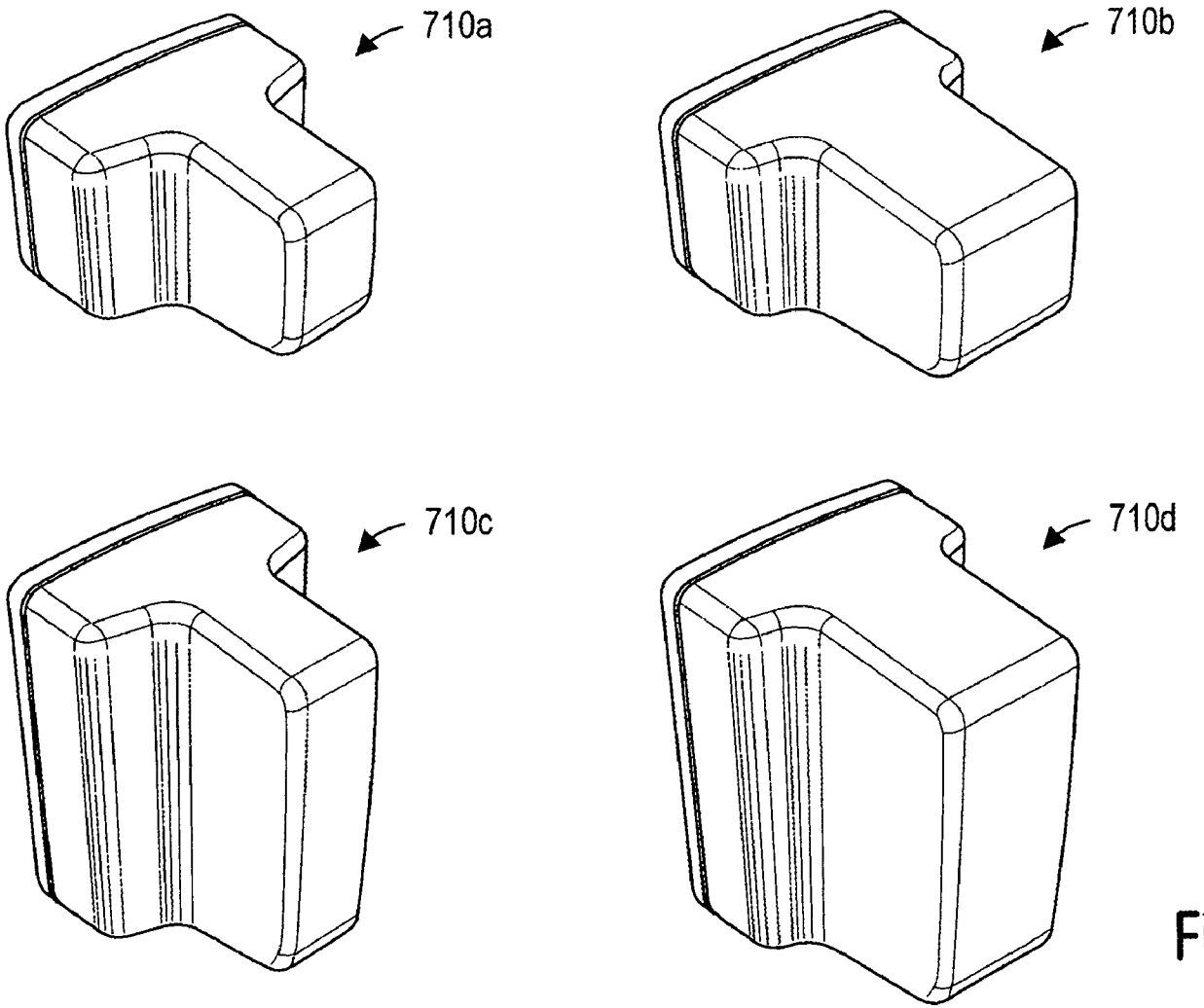
FIG. 7 illustrates how consistent visual cues may be applied to printer consumables having different capacities.

FIG. 7 illustrates how features facilitating intuitive installation of the consumable may be applied to a family of differently-sized consumables. Consumables may, for example, be sold with different fluid capacities to accommodate different usage patterns by the users, or different size consumables may be used for different ink colors or different fluids, such as preconditioners or overcoats. As illustrated in FIG. 7, containers 710*a* and 710*b* may be adapted to mate with the same receiving station of a printer to provide different ink capacities; containers 710*c* and 710*d* mate with a larger receiving station, such as might be used for black ink.

While the exemplary embodiments described above have a grasping portion that is narrowed from the printer interface portion in a horizontal direction, the grasping portion could alternatively be narrowed in the vertical direction while still providing the visual cues to the user for handling and installation.

While the present invention has been particularly shown and described with reference to the foregoing exemplary and alternative embodiments, those skilled in the art will understand that many variations may be made therein without departing from the spirit and scope of the invention as defined in the following claims. This description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements.

What is claimed is:

1. A printer consumable for replaceable installation in a printer, the consumable comprising:

a printer interface end having a substantially flat outer face with a surface area within which printer functional interfaces are arranged;

a substantially planer user interface end distal from the printer interface end, the user interface end having an area that is less than the surface area of the printer interface end, and wherein the user interface end is devoid of printer functional interfaces;

a grasping portion integral with the user interface end extending from the user interface end towards the printer interface end;

finger stops integral with the grasping portion and positioned between the printer interface end and the user interface end, the finger stops extending outwardly from the grasping portion, the finger stops having a combined surface area substantially equal to a difference between the surface area of the printer interface end and the area of the user interface end.

2. The printer consumable for replaceable installation in a printer of claim 1, wherein the user interface end, the grasping portion and the finger stops are formed of substantially flat segments joined by rounded corners.

3. The printer consumable for replaceable installation in a printer of claim 1, wherein the printer functional interfaces include at least a fluid port, an electrical interface, and a keying feature positioned on the substantially flat face.

4. The printer consumable for replaceable installation in a printer of claim 1, further comprising integrally formed indicia of consumable contents.

5. The printer consumable for replaceable installation in a printer of claim 4, wherein an outer surface of the grasping portion further comprises the indicia of consumable contents denoting a color of a consumable content by having at least a portion of the outer surface of the grasping portion being substantially the same color as the color consumable content.

6. The replaceable printing consumable of claim 4, wherein the indicia of consumable contents comprises multiple indicia of consumable contents.

7. The replaceable printing consumable of claim 1, wherein a cross-sectional area of the grasping portion increases from the user interface end towards the finger stops.

* * * * *